United States Patent [19]

Kubota et al.

[11] Patent Number: 5,061,019

[45] Date of Patent: Oct. 29, 1991

[54] HEAT INSULATING BOX STRUCTURE AND MANUFACTURING METHOD THEREFOR

[75] Inventors: Toshiaki Kubota, Ora; Hiroshige Hayashi, Oizumi; Yoshirou Ishizaka, Ora; Hiroshi Naganuma, Oizumi; Zenichi Kakinuma, Sano, all of Japan

[73] Assignee: Sanyo Electric Co., Ltd., Osaka, Japan

[21] Appl. No.: 509,965

[22] Filed: Apr. 16, 1990

[30] Foreign Application Priority Data

Apr. 18, 1989 [JP] Japan ..... 1-98326

[51] Int. Cl.[5] ..... A47B 81/00

[52] U.S. Cl. ..... 312/214

[58] Field of Search ..... 312/114, 214, 116

[56] References Cited

FOREIGN PATENT DOCUMENTS

| | | | |
|---|---|---|---|
| 2942402 | 4/1981 | Fed. Rep. of Germany | 312/116 |
| 61-63125 | 5/1986 | Japan . | |
| 61-173068 | 6/1986 | Japan . | |
| 62-1976 | 12/1987 | Japan . | |

*Primary Examiner*—Joseph Falk

*Attorney, Agent, or Firm*—Darby & Darby

[57] ABSTRACT

A heat insulating structure having a lower case whose top surface is arranged to be an opening through which goods are inserted and withdrawn and an upper case whose front surface is arranged to be an opening through which goods are inserted and withdrawn, the upper and lower cases each being formed by inner and outer boxes leaving a gap therebetween the heat insulating structure comprising: two pour holes formed in a wall of the upper case; a passage for establishing communication between the gaps of the upper case and the lower case; a heat insulating pipe having an end portion communicating with one of the pour holes of the upper case and extending from the one pour hole and through the gap of the upper case and having its other end portion communicating with the gap of the lower case; foam heat insulating material is injected, in the form of a foaming agent, through the other pour hole of the upper case to the gap of the upper case so as to foam and solidify; and foam heat insulating material in the form of a foaming agent is also injected through the pour hole of the upper case and through the pipe to the gap of the lower case to foam and solidify.

6 Claims, 12 Drawing Sheets

HEAT INSULATING BOX STRUCTURE AND MANUFACTURING METHOD THEREFOR

BACKGROUND OF THE INVENTION i) Field of the invention

The present invention relates to a heat insulating box structure and a manufacturing method therefor, and, more particularly, to a heat insulating box structure filled with foam heat-insulating material in a gap between the inner and the outer boxes thereof and a manufacturing method therefor.

ii) Description of the prior art

A heat insulating box structure disclosed in Japanese Patent Laid-Open No. 61-173068 is constituted in such a manner that a heat insulating and flexible pipe is fastened along the inner surface of the outer box, the heat insulating and flexible pipe having an end portion positioned in the vicinity of an injection port (or a pour hole) formed in the outer box and another end portion positioned in the vicinity of a position where foam solution is injected through the above-described injection port. The pipe is arranged in a zigzag manner so that the foam solution injected through the injection port passes through the thus arranged zigzag pipe.

According to the above-described conventional structure, the pipe is arranged in such a manner that an end portion thereof is positioned in the vicinity of the injection port formed in the outer box and another end portion is positioned in the vicinity of the position where the foam solution is injected. However, it is difficult for the foam solution to foam uniformly in the overall body of a heat insulating box structure having two storage areas disposed close to each other and arranged such that the foam solution is injected into the space formed between the inner box and the outer box thereof. Thus, a problem arises in that portions which are not filled with the foam solution occur and residual air is thereby generated. What is worse, the distribution of the enclosed heat insulating material is not uniform.

On the other hand, even if the quantity of the foam solution to be injected is increased for the purpose of eliminating the portions which are not filled with the foam solution, the difficulty of distributing the increased amount of foam solution cannot be overcome. Thus, a problem arises in that the heat insulating material distribution cannot be uniform in the overall body of the heat insulating box structure. It might therefore be feasible to employ a structure in which other injection ports are formed in other surfaces in addition to the above-described surface so that a plurality of the storage areas are independently supplied with the foam solution. However, a problem arises in that the injection operation becomes too complicated since a plurality of injection guns must be used or the heat insulating box structure must be turned so as to fill it with the foam solution.

SUMMARY OF THE INVENTION

According to the present invention, there is provided a heat insulating structure having a lower case whose top surface is arranged to be an opening through which goods are to be inserted and withdrawn and an upper case whose front surface is arranged to be an opening through which goods are inserted and withdrawn, the heat insulating structure comprising: a box structure for forming the upper case and the lower case by coupling an inner box and an outer box and having a gap between the two boxes; at least two pour holes formed in a wall of either the upper case or the lower case of the box structure; a passage for establishing communication between the gaps of the upper case and the lower case; a heat insulating pipe having an end portion confronting either of the two pour holes of the case that has the pour holes, at least extending from the either of the two pour holes to the communication passage after it has passed through the gap of the case and having another end portion confronting the gap of the other case; a foam heat insulating material injected, in the form of a foam solution, through the other pour hole of the two pour holes formed in the case that has the pour holes to the gap of the case so as to foam and solidify; and another foam heat insulating material injected, in the form of a foam solution, through the pour holes of the case to the gap of the other case after it has passed through the pipe so as to foam and solidify.

That is, according to the present invention, the foam solution is injected to the other case of the upper and the lower cases is filled with the foam solution through the pipe extended from the pour hole of the two pour holes formed in the case and having a specific heat insulating characteristic so that the foam solution is allowed to foam and solidify and becomes the foam heat insulating material for the case.

The case is directly supplied with the foam solution from the other pour hole so that the foam solution is allowed to foam and solidify and becomes the foam heat insulating material for the case.

Thus, the problem which arises in that the connecting portion connecting the two cases reduces the area of the communication passage and the heat insulating material cannot be satisfactorily supplied to the two cases can be overcome by the arrangement of the pipes.

Other and further objects, features and advantages of the invention will be appear more fully from the following description.

BRIEF DESCRIPTION OF THE DRAWINGS

FIG. 1 is a vertical cross sectional view which illustrates the right side wall portion of a heat insulating box structure;

FIG. 2 is a perspective view which illustrates the heat insulating box structure;

FIG. 3 is a cross sectional view taken along line A—A shown in FIG. 2;

FIG. 4 is a cross sectional view which illustrates the heat insulating box structure in a state before the foaming of the foam solution;

FIG. 5 is a perspective view which illustrates a portion in the vicinity of an injection port, in which a portion is illustrated in a cross sectional view;

FIG. 6 is a cross sectional view which illustrates a state where the heat insulating box structure has been secured to jigs for use at the time of foaming the foam solution;

FIG. 7 is cross sectional view which illustrates a portion including a breaker on the right side portion of the heat insulating box structure;

FIG. 8 is a horizontal cross sectional view which illustrates a communicating portion formed on the side wall of the heat insulating box structure;

FIG. 9*a* is perspective view which illustrates the heat insulating box structure when viewed from a rear portion, in which a portion is illustrated in a cross sectional view;

DETAILED DESCRIPTION OF PREFERRED EMBODIMENTS

A preferred embodiment of the present invention will now be described with reference to FIGS. 1 to 9.

Figure 1:
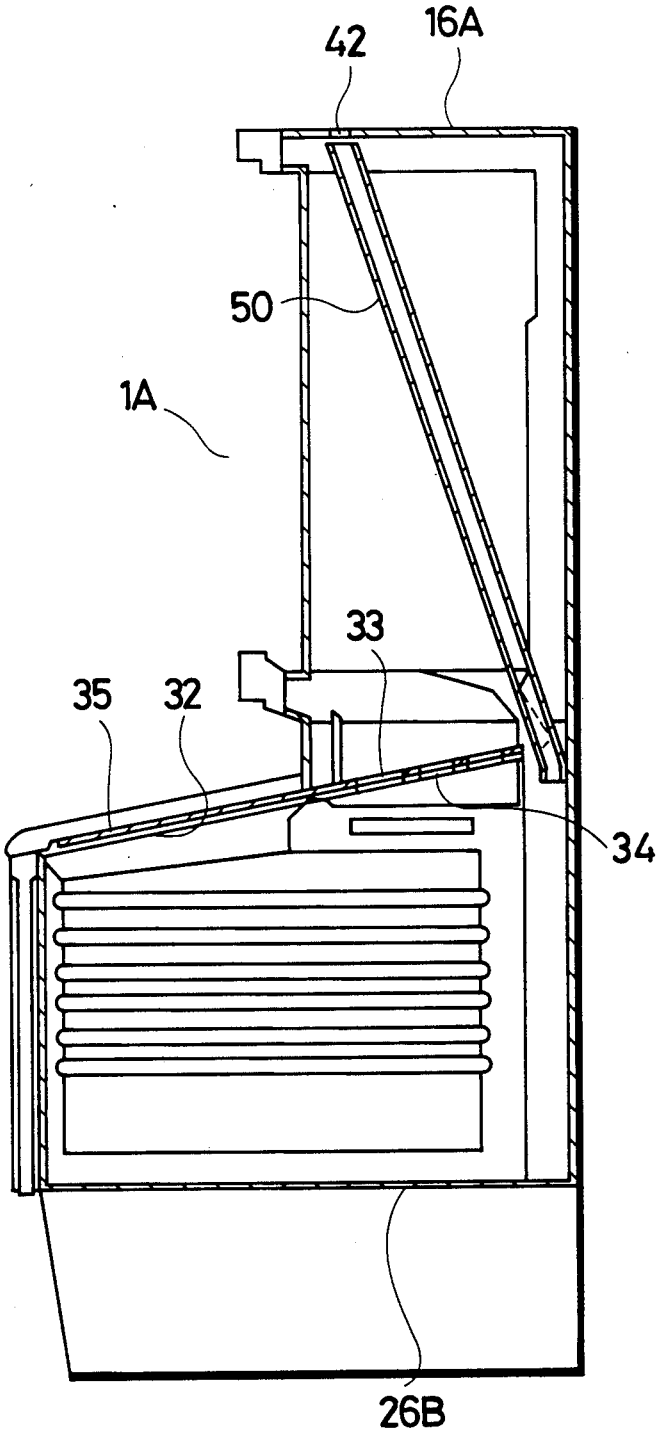
FIGS. 1 to 9 illustrate an embodiment of the present invention, where
Figure 2:
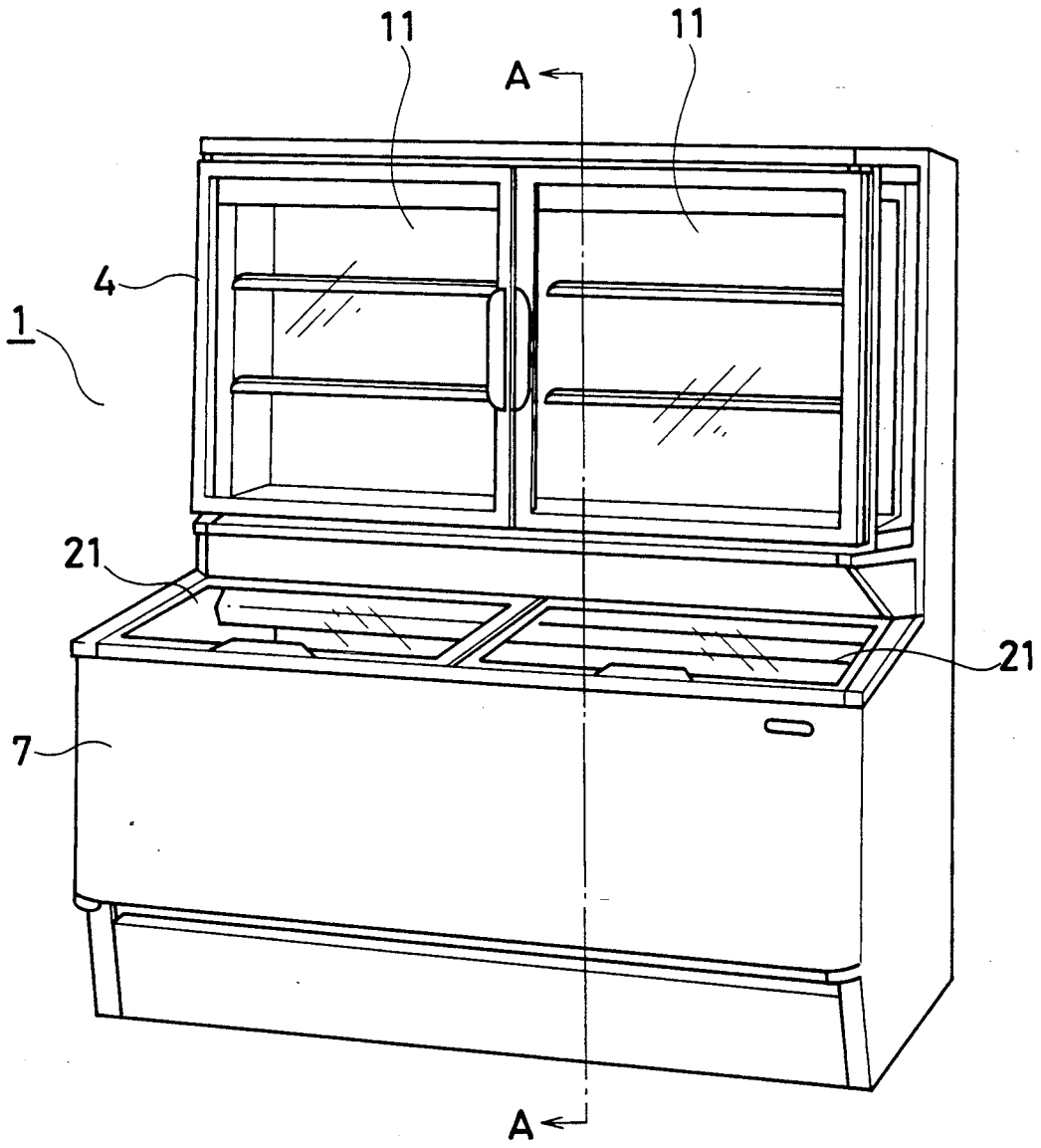
Figure 3:
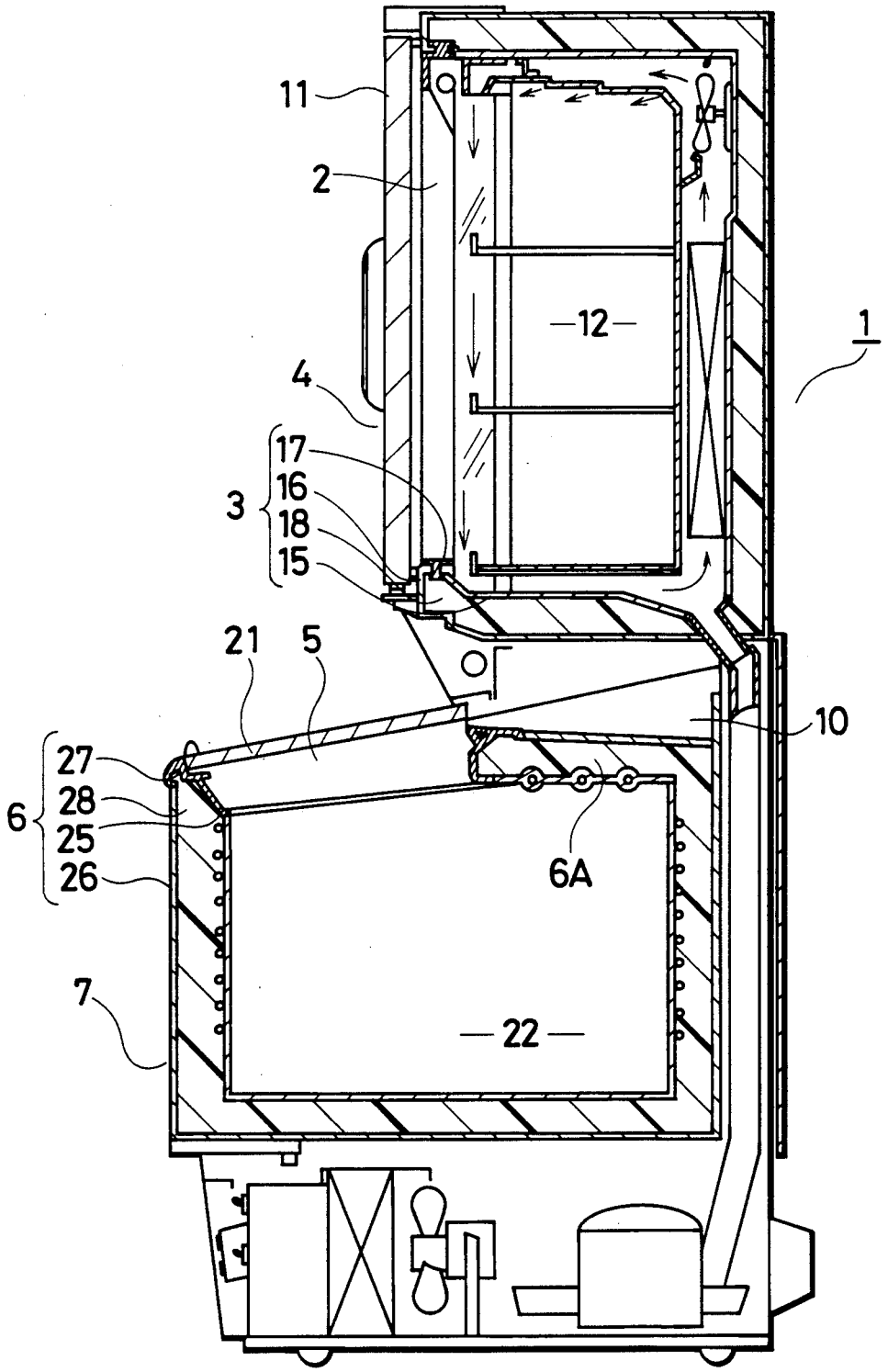

Referring mainly to FIG. 3, reference numeral 1 represents a heat insulating box structure exemplified by a dual type show case whose body comprises an upper case 4 formed by a heat insulating wall 3 having, in its front surface, an opening 2 through which goods are passed so as to be stored or ejected and a lower case 7 formed by a heat insulating wall 6 having, in its top surface, an opening 5 through which goods are passed so as to be stored or ejected.

The upper case 4 has a transparent door 11 capable of opening and closing the opening 2, the transparent door 11 forming, in association with the heat insulating wall 3, an upper storage compartment 12.

The heat insulating wall 3 is constituted by an inner box 15 whose front surface has an opening and made of metal, for example, a galvanized steel plate, an outer box 16 accommodating the inner box 15 with providing a certain distance from the inner box 15 and arranged in such a manner that its front surface has an opening and made of metal, for example, a galvanized steel plate, a resin breaker 17 for adiabatically connecting the above-described two boxes 15 and 16, and foam heat insulating material 18 such as rigid polyurethane foamed and enclosed in gap P (see FIG. 4) which surrounds the upper storage compartment 12 constituted by the above described breaker 17 and the two boxes 15 and 16.

The lower case 7 has a transparent door 21 disposed at the opening 5 and capable of moving backward and forward, the transparent door 21 forming, in association with the heat insulating wall 6, a lower storage compartment 22.

The heat insulating wall 6 is constituted by an inner box 25 whose top surface has an opening and made of metal, for example, made of galvanized steel plate, an outer box 26 accommodating the inner box 25 with providing a certain distance from the inner box 25 and arranged in such a manner that its top surface has an opening and made of metal, for example, made of galvanized steel plate, a resin breaker 27 disposed between the top end portions of the two boxes 25 and 26, and foam heat insulating material 28 such as hard polyurethane foamed and enclosed in gap Q (see FIG. 4) which surrounds the upper storage compartment 22 constituted by the above-described breaker 27 and the two boxes 25 and 26. Furthermore, a wall 6A projecting forwardly over the rear wall of the heat insulating wall 6 is formed behind the upper opening 5 in a direction in which the projecting wall 6A reduces the depth of the opening 5. As a result, a hexahedron constituted by the right, left, front, rear, bottom and the projecting walls is formed.

Figure 4:
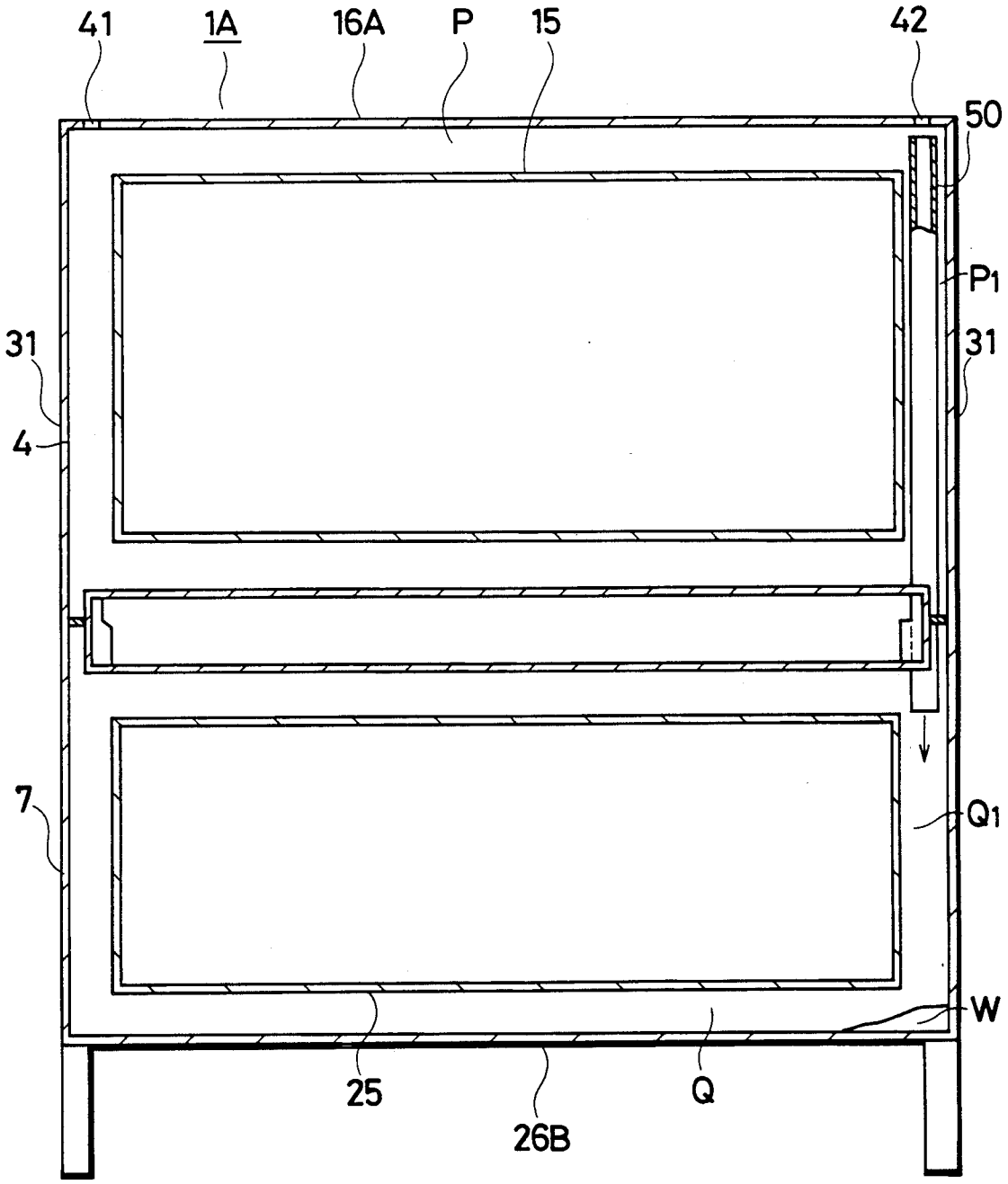
Figure 7:
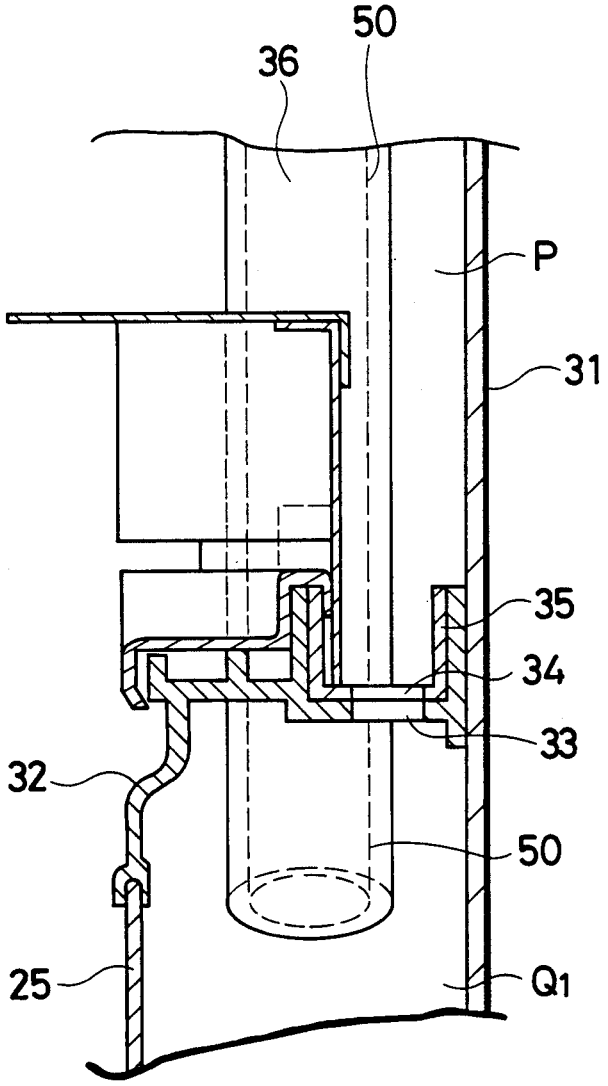
Figure 8:
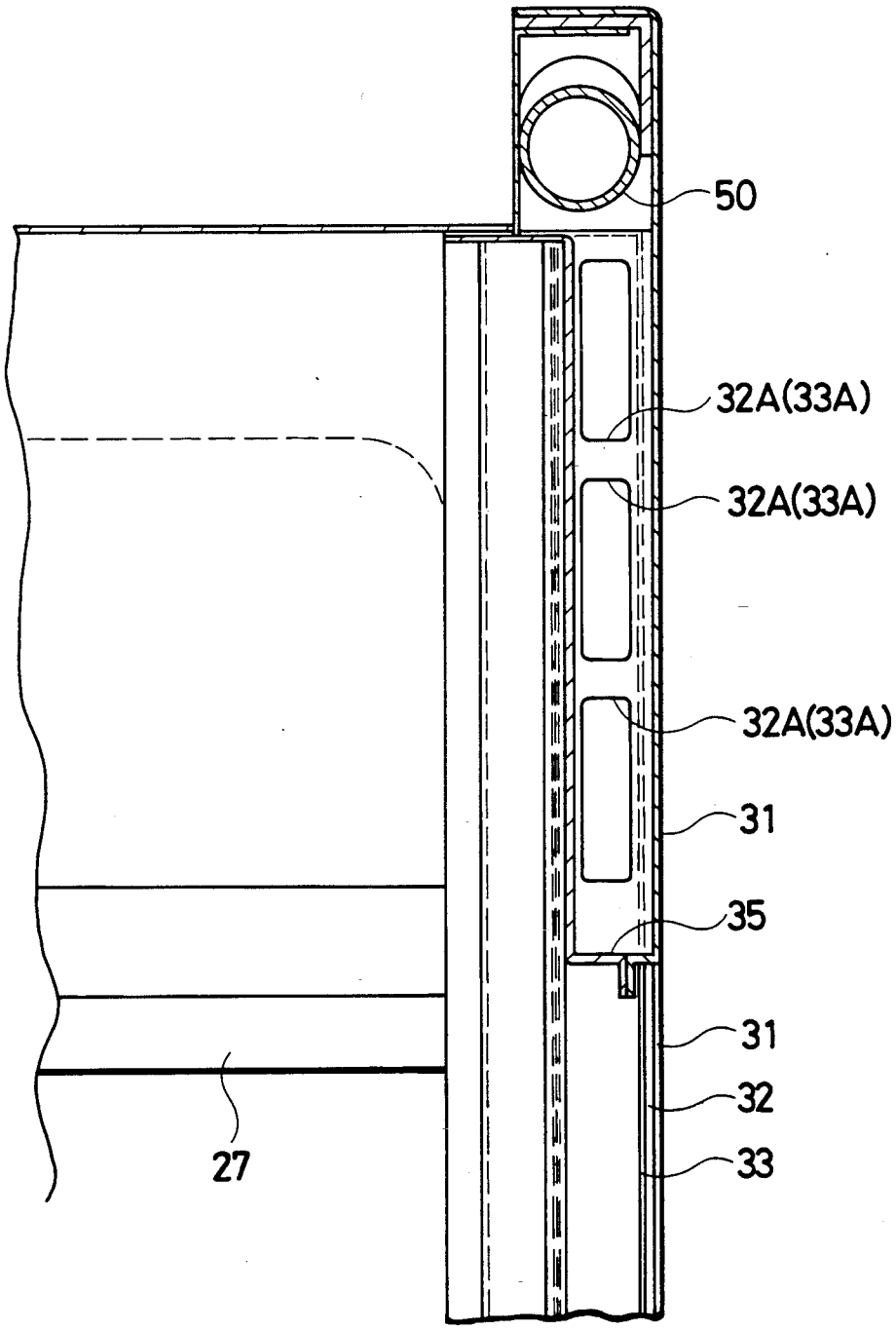
Figure 9:
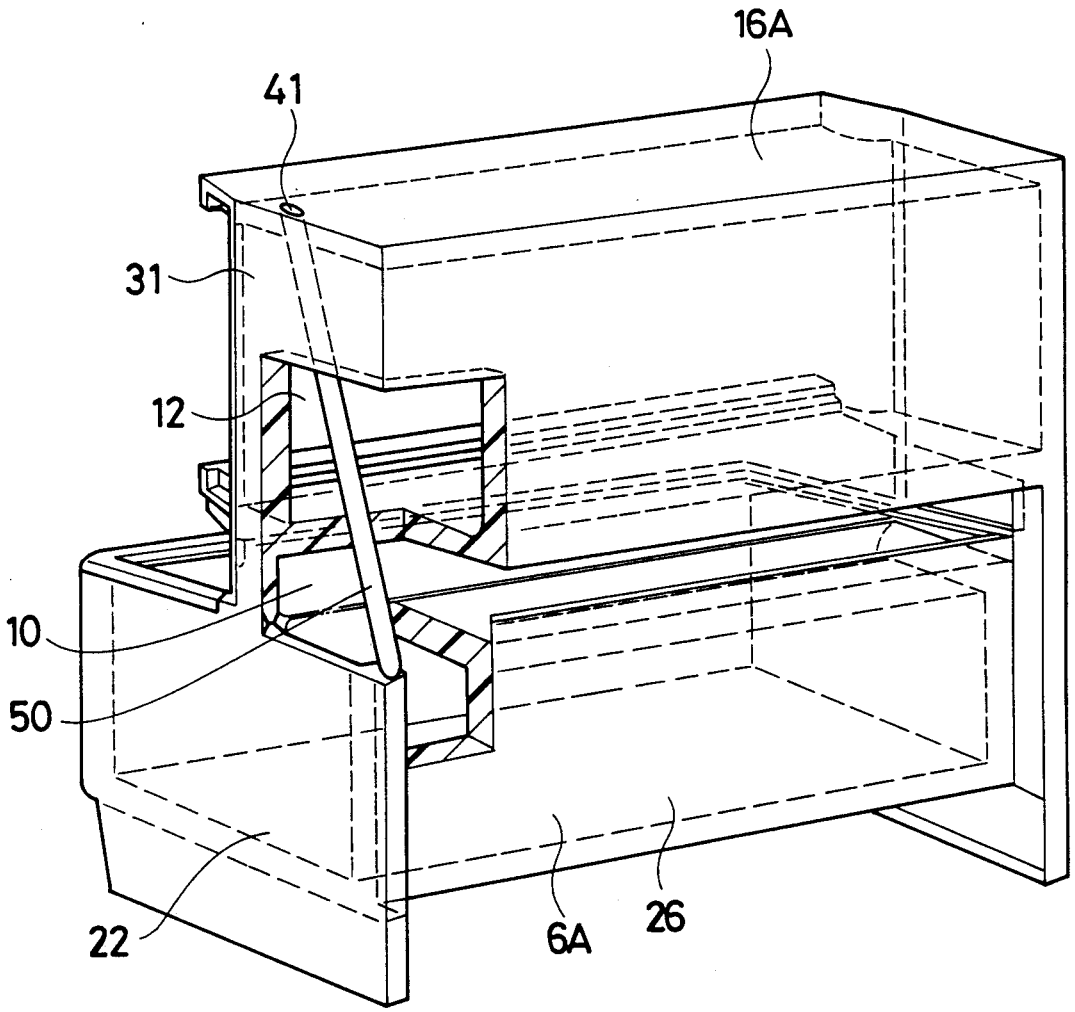

Particularly referring to FIGS. 4 and 7, each of the right and the left plates 31 of the outer boxes 16 and 26 is formed by a single plate covering both the upper and the lower cases 4 and 7. Right and left resin breakers 32 are respectively disposed on the upper portions of the right wall and the left wall, the right and the left breakers 32 being formed between the inner end portion of the inner box 25 and the inner surface of the outer box 26 and extending from the front end portions of the right and left walls to the position adjacent to the rear wall. Each of the right and the left breakers 32 has a port 33 through which the heat insulating material passes through and formed as a communication hole in the its rear portion which corresponds to the side wall of the upper storage 12. A metal reinforcing breaker 35 having a U-figure cross sectional shape facing sideward and having a communication port 34 through which the heat insulating material passes and formed at a position corresponding to the port 33 is placed on the breakers 32 and 33. As a result, the gaps P and Q can be connected to each other in the right and the left wall portions by the port 33 and the communicating port 34. Reference numeral 36 represents a stopper plate acting to stop leakage of the heat insulating material which has passed through the above-described two ports into the front portion of the breaker 32 and a door accommodating portion 10.

Then, a method of manufacturing the heat insulating walls 3 and 6, that is, the heat insulating box structure formed by enclosing the heat insulating material in a space created between the inner and the outer boxes forming the heat insulating walls 3 and 6 will now be described.

Figure 6:
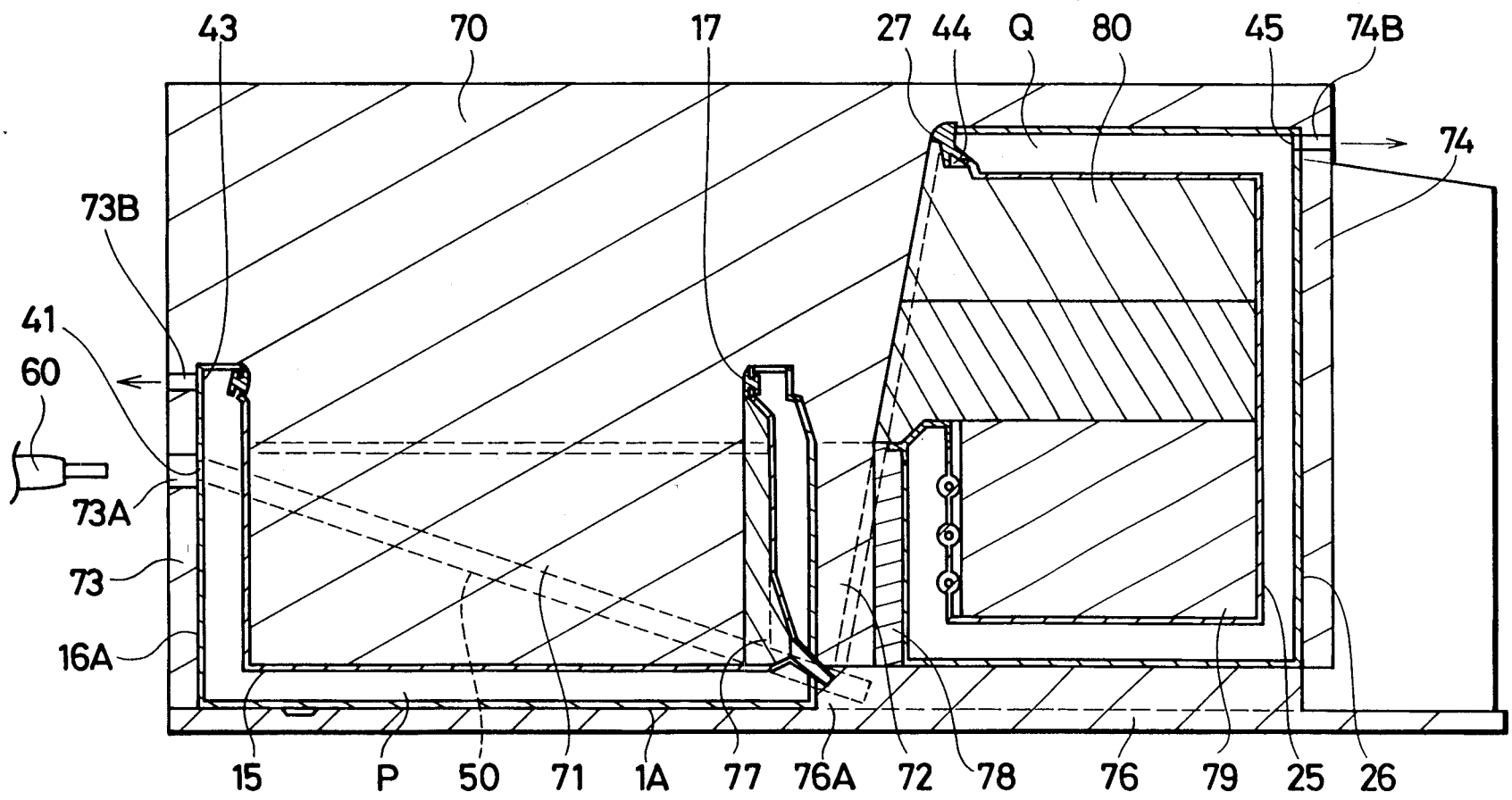
Figure 10:
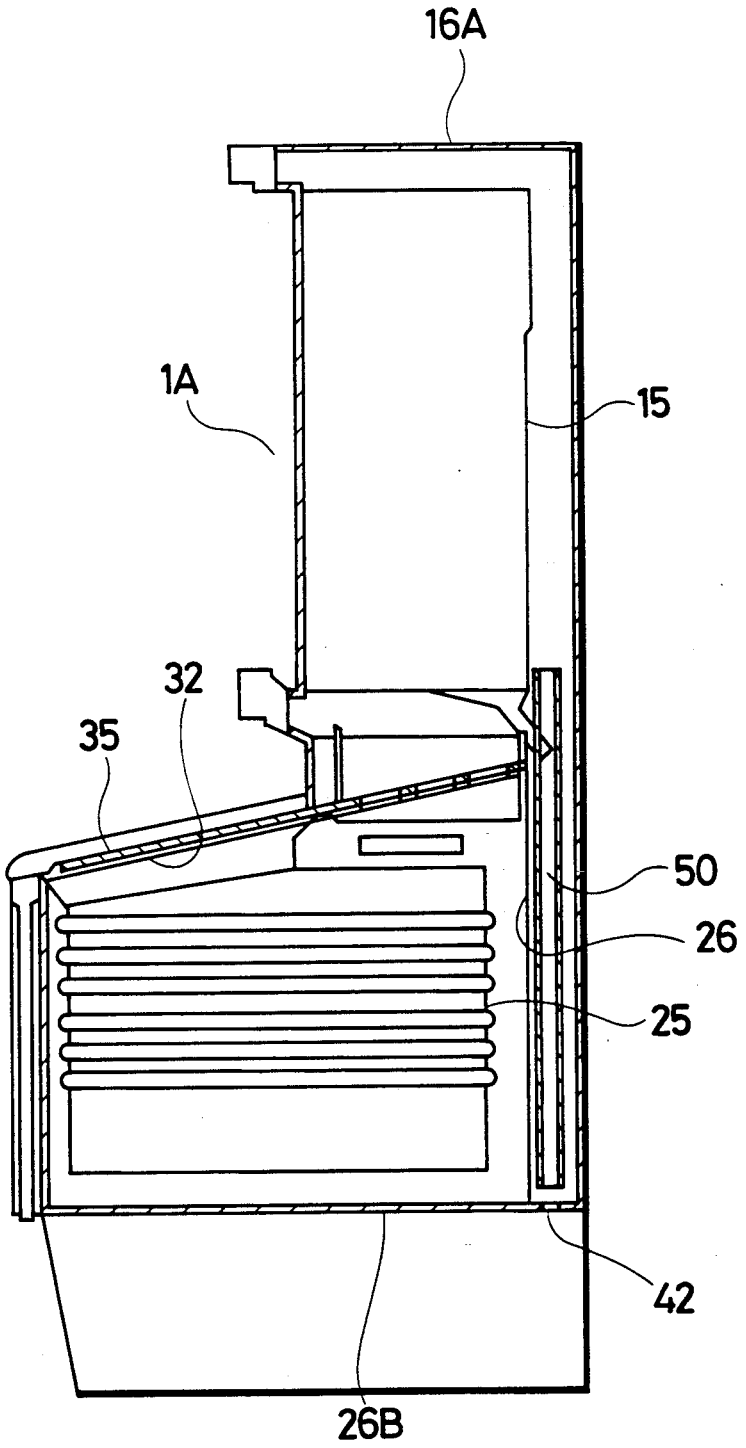
FIG. 10 is a view which corresponds to FIG. 1 and illustrates another embodiment of the present invention.

Referring to FIG. 4, reference numeral 41 represents an injection port as a pour hole formed in the front portion (at the left end portion in a from elevational view according to this embodiment) of an end portion of a top plate 16A of the outer box 26, the injection port 41 corresponding to the gap P formed by the inner and the outer boxes which form the heat insulating wall 3 and the breaker 17. Reference numeral 42 represents an injection port as a pour hole formed in the front portion (at the right end portion in a front elevational view according to this embodiment) of another end portion of the top plate 16A of the outer box 26, the injection port 42 corresponding to the inner and the outer boxes 25 and 26 which form the heat insulating wall 3 and the Gap Q formed by the breaker 27. Referring to FIG. 6, reference numeral 43 represent a multiplicity of upper exhaust ports formed in the top plate 16A of the outer box 26. Reference numeral 44 represent a multiplicity of breaker exhaust ports formed in the breaker 27, and reference numeral 45 represents a multiplicity of lower exhaust ports formed in the front end portion of the bottom plate of the outer box 26. Although the two injection ports are formed according to this embodiment, the present invention is not limited to the above described structure. For example, the number of the injection ports may be increased. An example in which the injection port 42 is formed in the bottom plate 26B of the outer box 26 is shown in FIG. 10.

Referring mainly to FIG. 4, reference numeral 50 represents a cylindrical pipe fastened to the inner surface of the right side plate of the outer box 26, the pipe 50 being made of corrugated paper having an adiabatic characteristic and having a surface whose viscosity is small, that is, a lustrous surface or a flexible resin. The pipe 50 is arranged in such a manner that its end portion is positioned close to the injection port 42 with a certain gap provided therebetween. The pipe 50 is then arranged to pass through a right gap P1 (see FIG. 4)

formed between the inner and the outer boxes 25 and 26 surrounding the upper storage 12. Another end portion of the pipe 50 reaches a gap formed behind the right reinforcing breaker 35 in which the opening of the end portion of the pipe 50 faces a right gap Q1 formed between the inner and the outer boxes 25 and 26 surrounding the lower storage 22.

Figure 5:
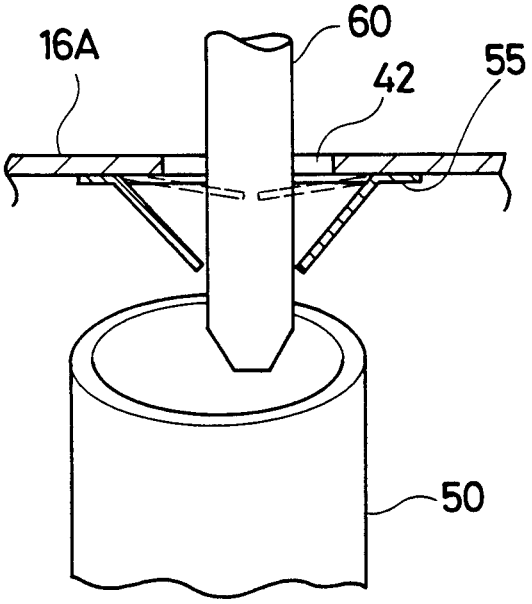

Reference numeral 55 represents a plate-like automatically-closing cap made of paper or a soft resin fastened, as shown in FIG. 5, to the inner surface of the top plate 16A of the outer box 26 in such a manner that the cap 55 covers the injection ports 41 and 42. The cap 55 is arranged to be forcibly opened by injection guns 60 injected through the injection ports 41 and 42, and is automatically restored due to its elasticity after the foam solution has been injected. The cap 55 is then forced toward and abutted against the outer box 26 by the foaming pressure of the heat insulating material so that the injection ports 41 and 42 are closed.

Referring to FIG. 6, a box structure 1A, which is formed by the inner and the outer boxes 25 and 26 and the breakers 17 and 27, is laid down in such a manner that its backside faces downwards, and is then fixed by upper and lower jigs 70 and 76, and inserts 77, 78, 79 and 80 which have been previously heated up to proper temperature. Then, it is subjected to the foaming operation. The lower jig 76 has a step 76A arranged to correspond to the shape of the back plate of the outer box 26 which projects over the back plate of the inner box 25. Reference numeral 77 represents a bottom insertion disposed in the bottom of the upper case 4, and reference numerals 79 and 80 represent inner insertions to be inserted into the inner box 25 of the lower case 7. The upper jig 70 comprises an upper insertion portion 71 to be inserted into the inner box 15 of the upper case 4, a lower insertion portion 72 to be inserted into a door accommodating portion 10 formed between the upper case 4 and the lower case 7, right and left portions (omitted from illustration) which are positioned to abut against the right and the left plates 31 of the box structure 1A, a top portion abutting against the top plate 16A of the box structure IA and having an injection passage 73A communicating with each of the injection ports 41 and 42 and a first exhaust passage 73B communicated with the upper exhaust port 43 and a bottom portion 74 abutting against the bottom plate 26B of the box structure 1A and having a second exhaust passage 74B communicated with the lower exhaust port 45. The upper jig 70 is suspended in such a manner that it can be moved upwards and downwards.

The box structure IA is laid down in such a manner that its opening 2 faces upwards, then it is placed on the lower jig 76. Then, the insertions 77 to 80 are inserted into predetermined portions, and the inner boxes 15 and 25 and the outer boxes 16 and 26 and the breakers 17 and 27 are pressed and fixed by the upper jig 70 which has been lowered.

After the above-described fixing operation has been completed, the injection gun 60 is, as particularly shown in FIG. 5, inserted into the injection port 42 which corresponds to the lower storage compartment 22 so that the automatic-closing cap 55 is forcibly opened and the injection gun 60 is positioned to face the end portion of the pipe 50. Thus, the foam solution such as the hard polyurethane resin is injected into the gap Q1 through the pipe 50. After a lapse of a predetermined time period (which is a predetermined time period which is substantially the same as time taken for the injected foam solution to foam and increase in the gap Q to perfectly cover the right and the left walls of the lower storage, for example, about 10 seconds), the injection gun 60 is inserted until it reaches the injection port 41 which corresponds to the upper storage 12 so that the automatically-closing cap 55 is forcibly opened. Then, the foam solution is injected into the space P by a quantity (which is called "a constant quantity") necessary to sufficiently fill the gap P which corresponds to the upper storage 12.

As shown in FIG. 4, the foam solution W which has been supplied through the pipe 50 foams and increases starting at the rear right corner portion of the bottom plate 26B until it reaches the front left corner portion of the same, the foam solution W foaming and increasing radially. During the passage, the foam solution W passes through a cream time in which the foam solution changes from liquid to foam, a gell time in which the foam increasing speed is lowered, a tack-free time in which the adhesiveness is weakened and a foam time in which the increase is stopped and the foam solution solidifies. As a result, the foam solution W becomes a foam heat insulating material 28 which fills the space. Air in the pipe 50 is exhausted via the automatically closing cap 55, the injection port 42 and the injection passage 73A by the foaming pressure of the foam solution W increasing in the pipe 50. Air in the gap Q is exhausted via the lower exhaust port 45 and the second exhaust passage 74B. It is gradually exhausted from the breaker exhaust port 44 which is formed in the breaker 27 centering the front left corner portion which is the final foaming region.

On the other hand, the foam solution W injected through the injection port 41 corresponding to the upper storage compartment 12 foams and increases starting at the lower left corner portion of the upper case 4 until it reaches the upper right corner portion of the same with gradually discharging inner gas in the upper exhaust port 43 and the first exhaust passage 73B. As a result, it is solidified and becomes the foam heat insulating material 18.

According to the above-described manufacturing method, the foam solution W can be directly injected through the injection port 42 via the pipe 50 for the purpose of forming the heat insulating wall 6. Therefore, even if a plurality of the injection ports are formed only in the top plate 16 of the outer box, a predetermined quantity of the foam solution W can be introduced into the desired gap Q regardless of the existence of the gap P formed adjacently to the injection port. Therefore, the undesirable diffusion into the gap can be prevented so that the above-described problem taken place in that the foam solution cannot be distributed to the overall heat insulating wall 6 can be overcome. Therefore, the overall body of the gap Q positioned away from the injection port can be uniformly distributed. The pipe 50 has a heat insulating characteristic and is filled with the heat insulating material. Therefore, the heat insulating characteristic of the heat insulating wall 3 cannot be deteriorated. The heat insulating wall 3 is formed by the foam solution injected through the injection port 41 which is independently formed from the above-described injection port 42. Therefore, the above-described problem taken place in that the foam solution cannot easily be distributed to the overall portion of the heat insulating wall 3 can be overcome. The final foaming region in the heat insulating wall 6 at a position adjacent to the initial foaming region in the heat insulating wall 3, and the breaker 32 having a port 33 formed therein and a reinforcing breaker 35 having the communication port 34 formed therein are positioned in the above described portion. Therefore, the increasing foam heat insulating material can move from the gap Q to the gap P so that the generation of the portions filled with no heat insulating material can be prevented. Furthermore, since the heat insulating walls 3 and 6 communicate with each other, the strength of the overall heat insulating box structure can be improved.

Although the injection port is formed in the top plate of the outer box in the structure according to this embodiment, a similar effect can be obtained from the structure in which the same is formed in the bottom plate of the outer box.

As described above, according to the heat insulating box structure 1, a predetermined number of the injection ports of the plurality of the injection ports can be used to inject the foaming agent to the gap formed between the inner and the outer boxes surrounding the storage positioned away from the injection ports. Furthermore, the other injection ports are used to inject the same to the gap formed between the inner and the outer boxes surrounding the storage positioned close to the injection ports. Therefore, the heat insulating material can individually be supplied to each of the gaps. In addition, since the foam solution injected through the desired injection ports are introduced to the desired gap through the pipe without exception, the intermediate diffusion of the foam solution into the gap adjacent to the injection ports can be prevented. Furthermore, the difficulty of distributing the heat insulating material to the gap positioned away from the position at which the foam solution, which has been injected through the injection ports, falls in can be overcome. In addition, since the injection ports are formed in one side of the outer box, a simultaneous injection or time lag injection of the foam solution can be easily conducted. Furthermore, the reinforcing breaker acts to prevent the deformation of the central portion of the side plate of the outer box. In addition, the reinforcing breaker is embedded in the heat insulating material so that the structural strength of the side wall can be improved.

Figure 11:
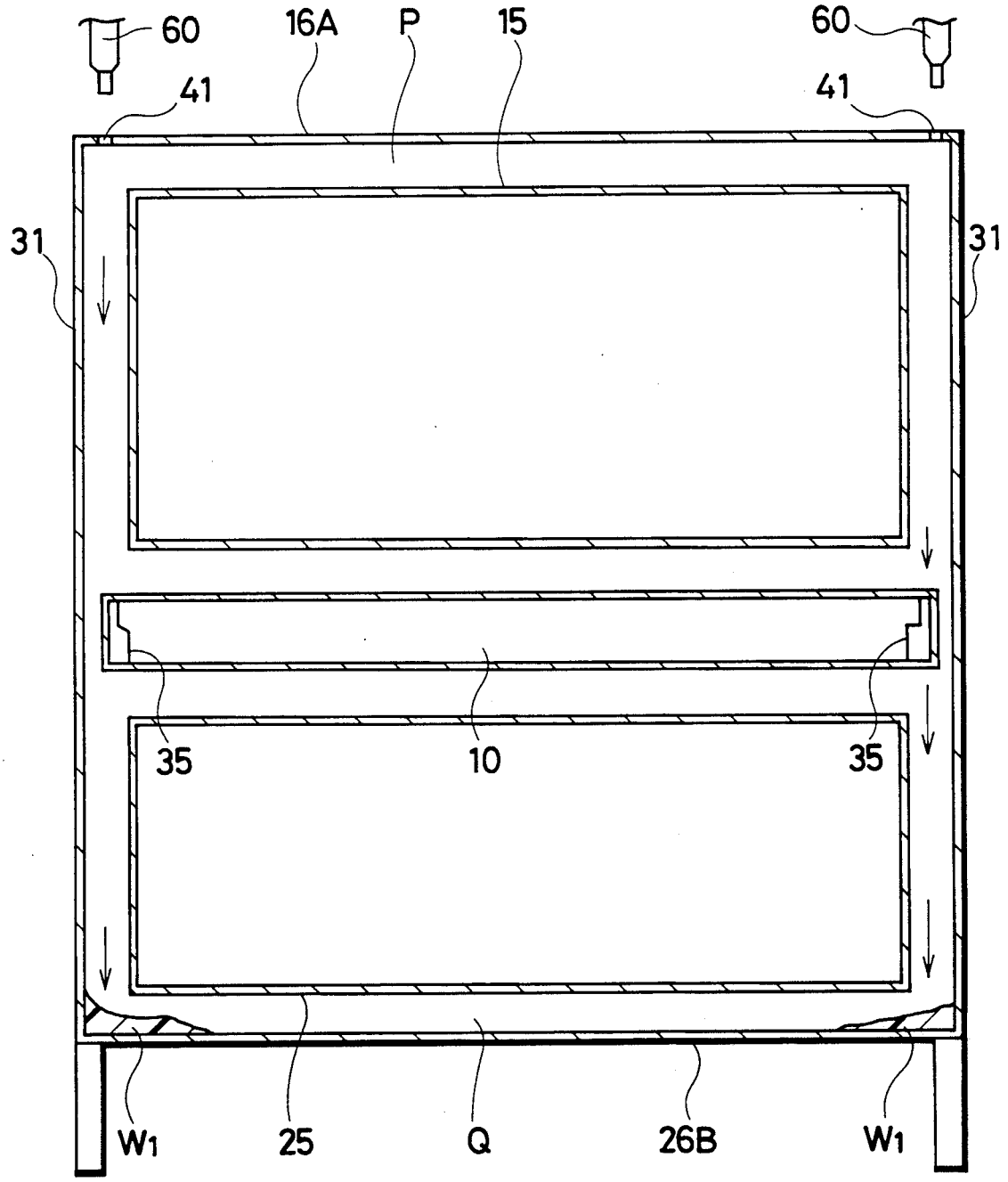
FIGS. 11 and 12 respectively illustrate the first injection and the second injection of the foam solution according to the other embodiment of the present invention.
Figure 12:
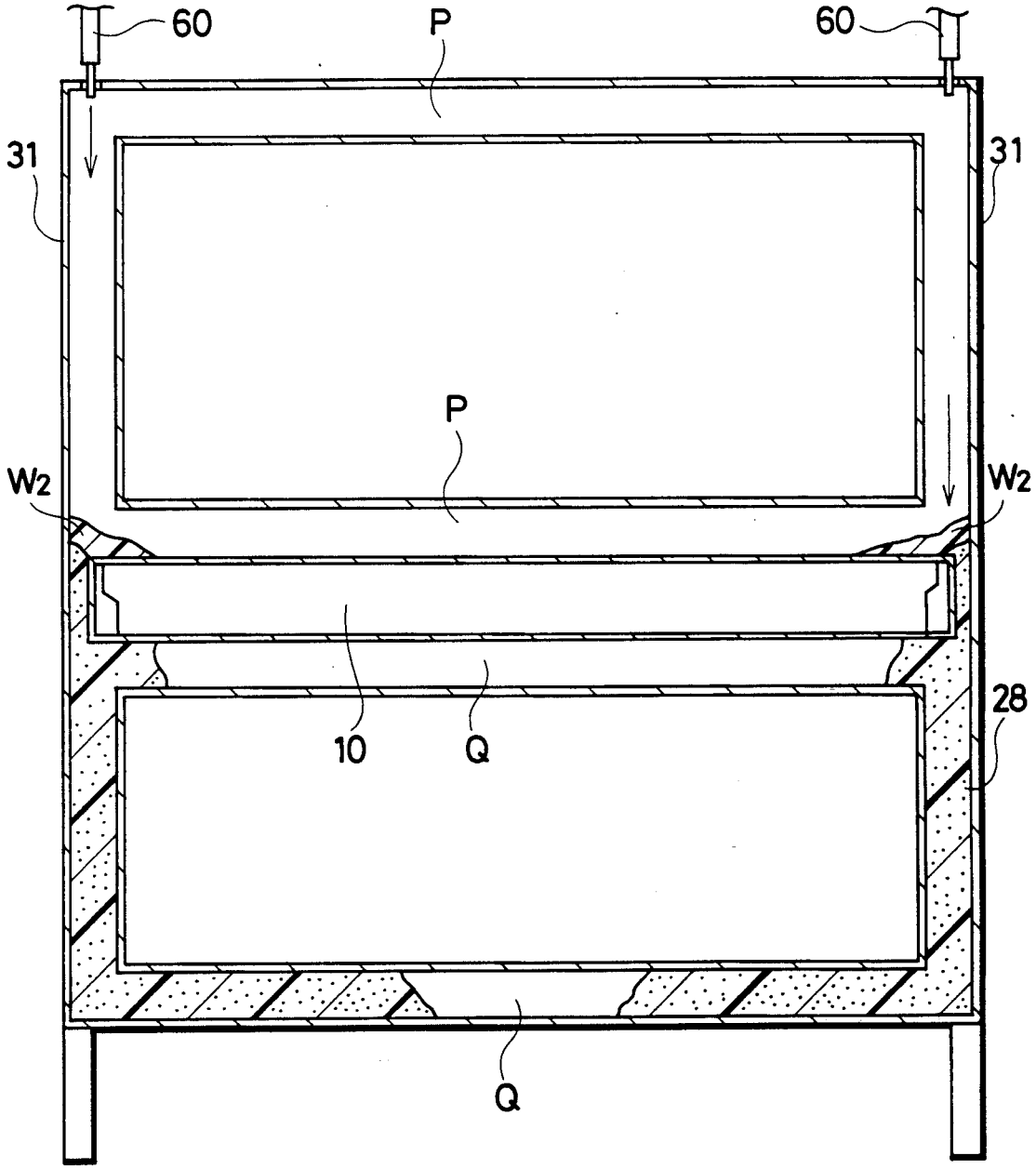

Another structure is shown in FIGS. 11 and 12, the structure being arranged such that the foam solution can be injected without using the pipe. That is, referring to FIGS. 11 and 12, an outer box 16A, the inner boxes 15 and 25 are secured to each of the jigs. After the above-described fixing operation, the injection gun 60 is inserted until it reaches the injection port 41 so that the automatically-closing cap is forcibly opened. Thus, the foam solution W1 such as hard polyurethane is injected into the space formed by the right and the left walls by a quantity (which is called "a predetermined quantity") which is able to sufficiently fill the gap Q surrounding the lower storage 22. After passage of a certain time period (for example, about 10 seconds) which is substantially the same as the time taken for the injected foam solution to sufficiently increase and foam in the gap Q to perfectly cover the right and the left walls of the lower storage, foam solution W2 is again injected through the injection port 41 by a quantity (which is called "a constant quantity") which is able to sufficiently fill the gap P surrounding the upper storage 12. The injected foam solutions W1 and W2 foam and increase radially starting from the position at which they first reach. The injected foam solutions W1 and W2 pass through a cream time in which the foam solution changes from liquid to foam, a gell time in which the foam increasing speed is lowered, a tack-free time in which the adhesiveness is weakened and a foam time in which the increase is stopped and the foam solution solidifies. As a result, the foam solutions W1 and W2 become foam heat insulating materials 18 and 28 which fill the spaces P and Q. Air in the space Q is exhausted via the lower exhaust port 44 and the second exhaust passage 74B, and is also gradually exhausted through the breaker exhaust port 43. On the other hand, gas in the gap P is exhausted through the upper exhaust port 42 and the first exhaust passage 73B.

As described above, the injection of the foam solution is arranged to comprise the first injection in which the foam solution is injected, by a predetermined quantity (which can fill the gap Q), through the injection port to the gap Q which corresponds to the storage positioned away from the injection port. The injection further comprises the second injection in which the same is injected by a constant quantity (which can fill the gap P) after a passage of time (a predetermined time period) estimated to taken for the increase of the foam solution injected by the first injection to reach the gap P which corresponds to the storage positioned adjacent to the injection port. Therefore, the predetermined quantity foam solution W1 and the constant quantity foam solution W2 can be independently injected into the corresponding gaps Q and P. As a result, the difficulty of sufficiently distributing the heat insulating material to both the gaps can be overcome in comparison to the conventional structure in which the injection of the foam solution is conducted only once. The above-described structure can be effective in a case where the structure of the box structure IA is complicated. Furthermore, the heat insulating material can be efficiently enclosed in a box structure according to this embodiment, having a gap positioned away from the injection port, having a large capacity into which the foam solution must be enclosed and thereby having a complicated structure. The increase of the heat insulating material 28 injected by the first injection and being increased to reach the portion at which the two gaps communicate with each other is prevented by the increase of the foam solution injected by the second injection. Therefore, the increase of the foam solution in the portions in which the foam solution has not been distributed as yet in the gap Q is promoted. As a result, each of the gaps can be satisfactorily filled with the foam solution.

Furthermore, heat insulating box structures of a type which has not been manufactured by integral foaming since they have the openings through which goods are ejected at different portions thereof can be manufactured by the integral foaming. Therefore, an advantage can be obtained in that the operation of coupling the heat insulating box structures with each other after the foaming process performed in the heat insulating box structures can be eliminated. The coupling operation has been necessary to be conducted according to the conventional structure. Furthermore, the covering operation for the junction can be eliminated. Therefore, the appearance of the produced heat insulating box structure can be maintained and the manufacturing operation can be easily completed. In addition, the heat insulating box structure can be manufactured by integral foaming, the heat insulating performance of the heat insulating walls can be uniform and the structural strength can be improved in comparison to the connection type structure.

As described above, a predetermined quantity of foam solution is, as the first injection, injected to the space surrounding the storage positioned away from a plurality of injection ports formed on the top plate or the bottom wall of the box structure, the thus injected foam solution then successively foaming and increasing in a predetermined time in the gap and moving toward the gap surrounding the storage compartment positioned adjacent to the injection port. After a lapse of time estimated to take for the foam solution to become the above-described state, a constant quantity of the foam solution is, as the second injection, injected. As a result, the increase of the foam solution toward the other gap can be prevented, causing the foam solution to increase in the portions which is not filled with the foam solution. Since the foam solution foams and increases in only the gap adjacent to the injection port in the second injection, a difficulty of distributing the heat insulating material to the gap adjacent to the injection port can be overcome.

On the other hand, the side wall of the heat insulating box structure manufactured by the method according to the present invention can be integrally formed by the foam heat insulating material. Therefore, the weight Of the overall body of the heat insulating box structure can be borne by the side wall which has been manufactured by integral foaming. Therefore, the structural strength of the overall heat insulating box structure can be improved. In addition, the operation necessary to join the heat insulating walls in which the storages are independently formed can be eliminated. Furthermore, a covering member for covering the joint between the heat insulating walls can be eliminated from the component.

Although the invention has been described in its preferred form with a certain degree of particularly, it is understood that the present disclosure of the preferred from has been changed in the details of construction and the combination and arrangement of parts may be resorted to without departing from the spirit and the scope of the invention as hereinafter claimed.

What is claimed is:

1. A heat insulating structure having a lower case whose top surface is arranged to be an opening through which goods are inserted and withdrawn and an upper case whose front surface is arranged to be an opening through which goods are inserted and withdrawn, said heat insulating structure comprising:

a box structure forming each said upper case and said lower case each box structure having a coupled inner box and an outer box whose walls are spaced from each other leaving a respective gap between the walls of said two boxes of each of the upper and lower cases;

at least two pour holes formed in a wall of one of said upper and said lower case box structures;

a passage for establishing communication between each of said gaps formed between the respective box structures of said upper case and said lower case;

a heat insulating pipe having one end portion communicating with one of said two pour holes of said one case, said pipe extending from said one pour hole and through said gap of said one case and having its other end portion communicating with said gap of said other case;

solidified foam heat insulating material in the gap of said one case formed from the injection of a foam solution through said other pour hole in said one case into said gap of said one case; and solidified foam heat insulating material in the gap of said other case formed by the injection of a foam solution through said one pour hole of said one case and through said pipe to said gap of said other case.

2. A heat insulating structure according to claim 1, wherein said lower case has a door accommodating portion having a space for accommodating a door for opening and closing said opening of said lower case through which said goods are inserted and withdrawn and said two foam heat insulating materials are integrally foamed in a right side wall and a left side wall.

3. A heat insulating structure according to claim 2, wherein a side wall portion positioned between said upper case and said lower case forms a side portion of said space of said door accommodating portion.

4. A heat insulating structure according to claim 2, wherein said door is a transparent door movable forward and rearward.

5. A heat insulating structure according to claim 1, wherein said lower case closes and couples a side portion of an upper opening between said inner box and said outer box, and a breaker member having a plurality of ports forming a communication passage at a position close to said upper case.

6. A heat insulating structure according to claim 5, wherein said other end portion of said heat insulating pipe is disposed at an end portion of said breaker member and confronts said gap of said other case.

* * * * *